US006279443B1

(12) United States Patent
Nakahara et al.

(10) Patent No.: US 6,279,443 B1
(45) Date of Patent: Aug. 28, 2001

(54) DIE CUT ROLL

(75) Inventors: Kenji Nakahara; Koichi Ibusuki; Shouji Eguchi; Kohei Kitahara; Kei Tokumoto; Shigeya Sakaguchi, all of Fukuoka (JP)

(73) Assignee: Nippon Tungsten Co., Ltd., Fukuoka (JP)

( * ) Notice: Subject to any disclaimer, the term of this patent is extended or adjusted under 35 U.S.C. 154(b) by 0 days.

(21) Appl. No.: 09/367,575

(22) PCT Filed: Dec. 24, 1998

(86) PCT No.: PCT/JP98/05931

§ 371 Date: Sep. 23, 1999

§ 102(e) Date: Sep. 23, 1999

(87) PCT Pub. No.: WO99/33621

PCT Pub. Date: Jul. 8, 1999

(30) Foreign Application Priority Data

Dec. 26, 1997 (JP) ..... 9-359215
Dec. 26, 1997 (JP) ..... 9-359217
Dec. 26, 1997 (JP) ..... 9-359235

(51) Int. Cl.[7] ..... B26D 1/12
(52) U.S. Cl. ..... 83/663; 83/346
(58) Field of Search ..... 83/663, 346, 331, 83/343, 347, 344, 506, 669

(56) References Cited

U.S. PATENT DOCUMENTS 1,044,931 * 11/1912 Simmons ..... 83/346
1,352,208 9/1920 Lovelace .
2,525,987 * 10/1950 Williamson ..... 83/346
3,618,654 11/1971 Merserve .
4,289,055 9/1981 Schriltz .
4,608,895 * 9/1986 Bell et al. ..... 83/343
4,759,247 * 7/1988 Bell et al. ..... 83/346
4,914,995 4/1990 Osborn .
4,949,615 8/1990 Jordan .
5,826,475 * 10/1998 Mysliwiec ..... 83/116
5,842,399 * 12/1998 Pfaff, Jr. ..... 83/343
5,967,009 * 10/1999 Truttmann et al. ..... 83/52

FOREIGN PATENT DOCUMENTS 2106998 11/1971 (DE) .
3229948 2/1984 (DE) .
7-227798 8/1995 (JP) .
8-71999 3/1996 (JP) .
8-72000 3/1996 (JP) .
08108399 4/1996 (JP) .
2593570 12/1996 (JP) .
9-267299 10/1997 (JP) .

* cited by examiner

*Primary Examiner*—Rinaldi I. Rada
*Assistant Examiner*—Omar Flores-Sánchez
(74) *Attorney, Agent, or Firm*—Jordan and Hamburg

(57) ABSTRACT

A die cut roll includes a rotary driving roll having projecting pressure cutting blades on a surface thereof formed in accordance with the shape of a product to be cut to thereby form a die cutter and an anvil roll adapted to receive an edge of each of the projecting pressure cutting blades of the die cutter. The rotary driving roll includes inclined finishing surfaces formed adjacent to a top smooth portion of an edge of each of the projecting pressure cutting blades by a grinding process so that the inclined finishing surfaces have grinding flaws which make an angle $\phi$ of 50°–90° to ridgelines defining the top smooth portion.

25 Claims, 5 Drawing Sheets

DIE CUT ROLL

TECHNICAL FIELD

This invention relates to a die cut roll used to cut sheet type products, such as paper diapers and sanitary napkins.

BACKGROUND OF THE INVENTION

This die cut roll comprises a combination of a die cutter formed by providing projecting pressure cutting blades, which are formed in accordance with the shape of a sheet type product to be cut, on a surface of a rotary driving roll, and an anvil roll. A sheet type work to be cut is made to run between the two rolls, and the die cutter is rotated in an anvil roll-pressing manner so as to cut the sheet type work to a predetermined shape with the projecting pressure cutting blades.

Many attempts have heretofore been made to improve the cutting quality of the cutting blades and prolong the lifetime thereof. For example, Japanese Patent Registration No. 2593570 discloses that the relation between the hardness of pressing ends of cutting blades and that of a surface of an anvil roll has influence upon the lifetime of the cutting blades, and that, when a hardness difference therebetween is set to more than 0.1, the lifetime of the cutting blades increases more than ten times. Japanese Patent Laid-Open No. 227798/1995 discloses the selection of specific materials for creating a proper hardness difference.

Japanese Patent Laid-Open No. 71999/1996 discloses the prolonging of the lifetime of cutting blades with respect to the shape thereof, i.e., it discloses the possibility of increasing the lifetime of cutting blades by setting the cutting blade width of an axial portion thereof smaller than that of a circumferential portion thereof. Japanese Patent Laid-Open No. 72000/1996 discloses crowned die cutters provided in both a die cut roll of a two-shaft driving system in which an anvil roll is driven by two synchronously rotated shafts, and a die cut roll of a single-shaft driving system in which a die cutter alone is driven with an anvil roll driven thereby.

Japanese Patent Laid-Open No. 267299/1997 discloses the techniques for improving the cutting quality of cutting blades without spoiling the strength thereof, by setting the angles $\alpha$, $\beta$ (apex angle becomes $\alpha+\beta$) of two inclined surfaces of each edge of the cutting blades with respect to a radius vector to $\alpha \neq \beta$, $0 \leqq \alpha \leqq 60°$, $25 \leqq \beta \leqq 80°$ and $5 \leqq \beta - \alpha \leqq 80°$.

The mode of abrasion of a die cut roll is complicated, and various things cause imperfect cutting of a work, chipping of projecting pressure cutting blades, early deterioration of the cutting performance of edges of the projecting pressure cutting blades and a decrease in the lifetime thereof to occur. Moreover, die cut rolls of different driving systems have greatly different modes of abrasion of a die cutter and an anvil roll, i.e., in a certain driving system, non-uniform abrasion of the rolls occurs, or a decrease occurs in the lifetime of the edge of the cutting blades ascribed to the chipping thereof. When the projecting pressure cutting blades on the surface of the die cutter are formed discontinuously in the rotational direction thereof, an extreme repeated stress is exerted on the pressure cutting blades, and a rate of abrasion thereof increases, so that the imperfect cutting of a work and the chipping of the pressure cutting blades occur. Even when the projecting pressure cutting blades are provided over the entire circumferentially continuous portion of the die cutter with the axial cutting length thereof decreasing due to the shape of the same, the concentration of stress on the blades causes an increase in the rate of abrasion thereof and the chipping thereof.

OBJECTS AND SUMMARY OF THE INVENTION

An object of the present invention is to provide a die cut roll having an improved cutting performance of the edges of projecting pressure cutting blades and a prolonged lifetime.

Another object of the present invention is to provide a die cut roll capable of resisting the stress occurring when an edge of a projecting pressure cutting blade and an anvil roll are brought into contact with each other adjacent to a top smooth portion of the edge.

Still another object of the present invention is to provide a die cut roll which has attained a long lifetime thereof with respect to greatly different modes of abrasion of a die cutter and an anvil roll occurring due to different die cut roll driving systems in use.

A further object of the present invention is to provide a die cut roll which has attained the reduction of stress concentration on projecting pressure cutting blades used for cutting a work to a final shape.

A first embodiment of this invention is directed to a die cut roll having inclined finishing surfaces of less than 0.1 $\mu$m in a surface roughness Ra on ridge surfaces adjacent to a top smooth portion of each projecting pressure cutting blade, or inclined finish surfaces having grinding muscles extending at 50°–90° and preferably 80°–90° with respect to ridge lines defining the top smooth portion, a surface roughness Ra being set to preferably less than 0.3 $\mu$m when the grinding muscle-carrying inclined finishing surfaces are formed.

Another embodiment is directed to a die cut roll, wherein one or both of a width and an apex angle of each projecting pressure cutting blade formed so as to extend in the axial direction of a die cutter is set smaller than those of each projecting pressure cutting blade formed so as to extend in the circumferential direction of the die cutter, preferably a width da and an apex angle $\theta$ a of an edge of the axially formed projecting pressure cutting blade, and a width dc and an apex angle $\theta$ c of an edge of the circumferentially formed one being set to $5 \leqq da \leqq 10$ $\mu$m, $60 \leqq \theta\ a \leqq 120°$, $10 \leqq dc \leqq 30$ $\mu$m, $80 \leqq \theta\ c \leqq 140°$, and $\theta\ a \leqq \theta\ c$.

For driving the die cut roll consisting of a die cutter and an anvil roll, two types of driving system can be adopted. One is the two-shaft driving type in which the driving force of a motor is transmitted to both shafts of the die cutter and the anvil roll by means of a gear to rotate the die cutter and the anvil roller synchronously. The other is the single-shaft driving type in which the driving force is transmitted to the shaft of the die cutter and the anvil roller which is in contact with the die cutter and is aligned in parallel with the axis of the shaft of the die cutter and is rotated by the friction with the die cutter.

Another embodiment of this invention is directed to a die cut roll having a difference between the hardness of a die cutter and that of an anvil roll with respect to above cut roll driving type, concretely speaking, $H_1$ representative of a hardness ($H_RA$) of at least an edge side portion of a cutting blade of a die cutter and $H_2$ representative of a hardness ($H_RA$) of at least an outer surface of an anvil roll satisfying the conditions $82 \leqq (H_1, H_2) \leqq 96 (H_RA)$ respectively, and $0 < H_2 - H_1 < 5$ when a two-shaft driving type die cutter is employed, and $-5 < H_2 - H_1 < 1$ when a single-shaft driving type die cutter is employed.

A further embodiment of this invention is directed to a die cut roll provided with projecting pressure cutting blades not directly working to cut a product, i.e. so-called supporting blades in addition to proper projecting pressure cutting blades, which are formed in accordance with the shape of products to be cut, so as to compensate for at least circumferentially non-continuous portions or axially cutting length-decreasing portions of the proper projecting pressure cutting blades.

The projecting pressure cutting blades for products of a die cutter may be provided so that the blades extend continuously in the circumferential direction of the die cutter, or so that end portions of the blades overlap in the circumferential direction thereof.

The materials out of which the die cutter and anvil roll can be formed include hard materials, such as a sintered hard alloy inclusive of a WC based alloy, a cermet inclusive of a Ti based alloy, high speed steel, and a ceramic material of $Al_2O_3.ZrO_2.SiC.Si_3N_4$, out of which hard materials of carbide bond, such as the WC based alloy and Ti based alloy in particular are preferably used.

Figure 1:
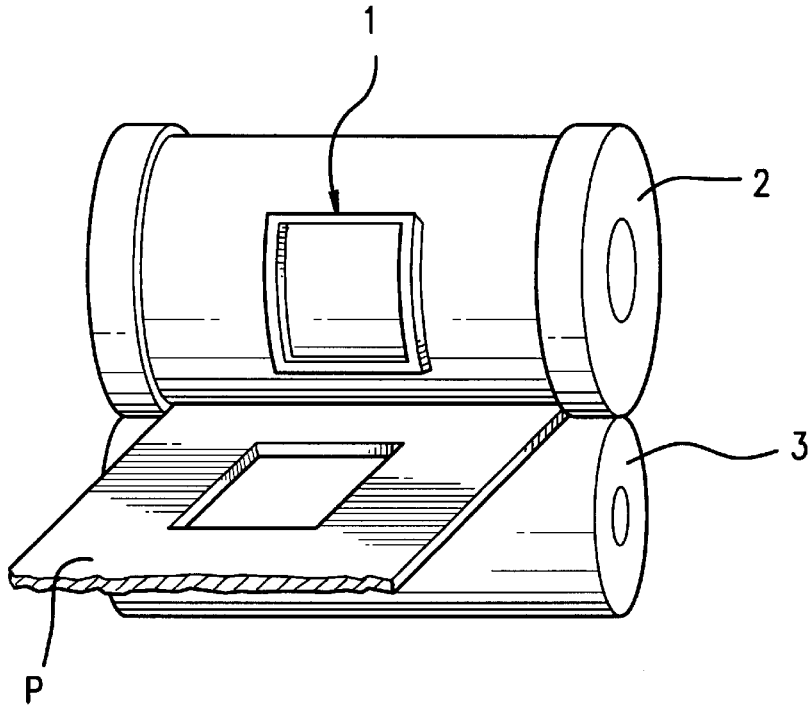
FIG. 1 shows an example of a die cut roll to which the present invention is applied.

The descriptions of the reference numerals and letters shown in the drawings are as follows.

1 . . . Projecting pressure cutting blades, 2 . . . Die cutter, 3 . . . Anvil roll, 2*a* . . . Die cutter gear, 3*a* . . . Anvil roll gear, 4 . . . Top smooth portion, 5 . . . Inclined grinding surface, 6 . . . Sintered ground, 7 . . . Inclined finishing surface, 8 . . . Grinding flaws, 9 . . . Motor, 10 . . . Supporting blades, 11 . . . Guide flanges, 12 . . . Continuous portion of a projecting pressure cutting blade, d . . . Width of a top smooth portion of a blade, θ . . . Apex angle of an edge, A . . . Product cutting regions, P . . . Work (object to be processed), X . . . Circumferential discontinuous portions of projecting pressure cutting blades, Y . . . Concentrated portion with respect to the axial direction of a projecting pressure cutting blade, Z . . . Range including circumferential end portions of a plurality of projecting pressure cutting blades.

BEST MODE FOR CARRYING OUT THE INVENTION

Embodiment 1

A die cut roll shown in FIG. 1 has a die cutter 2 formed by providing a surface of a rotary driving roll with a projecting pressure cutting blade 1 formed in accordance with the shape of products to be cut, and an anvil roll 3 disposed under the die cutter and adapted to receive an edge of the projecting pressure cutting blade, and a sheet type work P to be cut is made to run between the two rolls and cut to a predetermined shape with the projecting pressure cutting blade 1 by rotating under pressure the die cutter 2 against the anvil roll 3.

Figure 2:
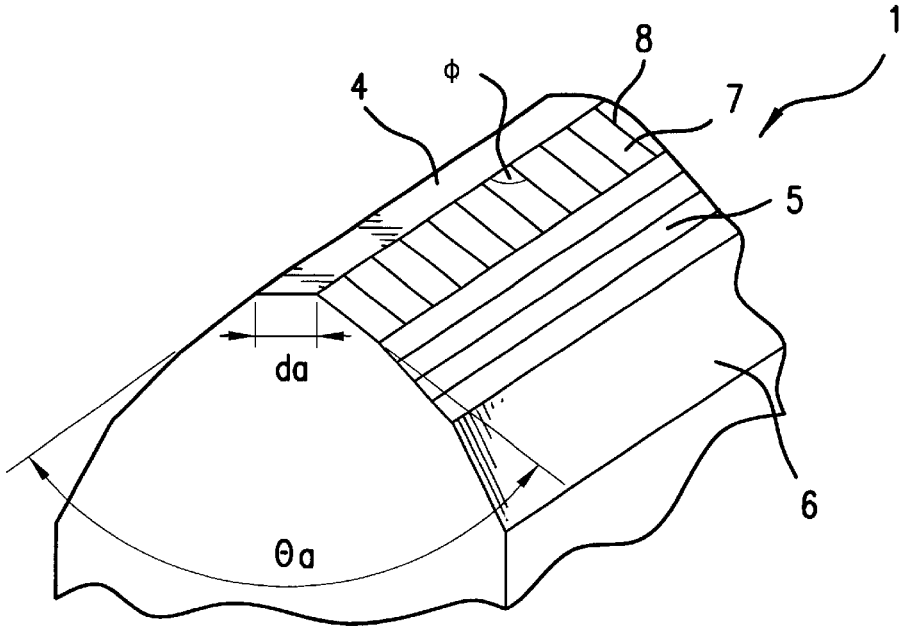
FIG. 2 shows the shape of an edge of a projecting pressure cutting blade provided on a surface of a die cutter of Embodiment 1 and which extends in an axial direction of the die cutter.

The projecting pressure cutting blade 1 shown in FIG. 1 is provided as shown in FIG. 2 with a top smooth portion 4, and inclined finishing surfaces 7 ground at right angles to the longitudinal direction of the top smooth portion 4. Each inclined finishing surface 7 is formed so that an angle ϕ thereof with respect to a relative ridgeline forming the top smooth portion 4 is in the range of 50°–90°, preferably 80°–90°, and it has grinding flaws 8. The inclined finishing surfaces 7 are finished to a surface roughness Ra of less than 0.3 μm.

Figure 2A:
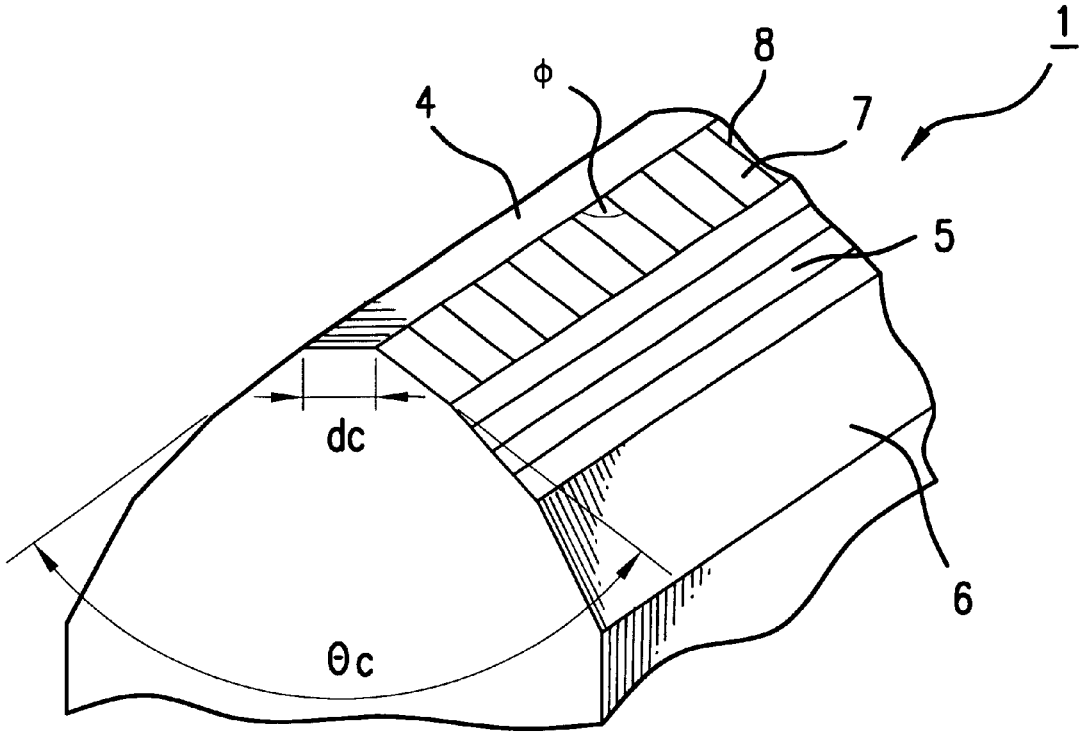
FIG. 2A shows the shape of an edge of a projecting pressure cutting blade provided on a surface of a die cutter of Embodiment 1 and which extends in a circumferential direction of the die cutter.

An apex angle θ made by the top smooth portion 4 having an edge width d at an edge of the projecting pressure cutting blade 1, and inclined finishing surfaces 7 which are symmetrical about the top smooth portion 4 is set so as to satisfy the following specific conditions. Moreover, the edge width da of the top smooth portion 4 and the apex angle θa made by the symmetrical, inclined finishing surfaces 7 in the axial direction of the die cutter 2 (see FIG. 2) and those in the circumferential direction thereof which is perpendicular to the axial direction (see FIG. 2A, the edge width being designated dc and the apex angle being designated θc) are preferably set to different values.

The specific conditions are as follows.

5 μm≦Axial edge width da≦10 μm

60°≦Axial apex angle θa≦120°

10 μm≦Circumferential edge width dc≦30 μm

80°≦Circumferential apex angle θc≦140°

Axial apex angle θa≦Circumferential apex angle θc

Out of these conditions, the axial blade width d in the axial direction of the die cutter has to be set small so as to obtain a required contact surface pressure. However, when this axial blade width is smaller than 5 μm, the chipping of the projecting pressure cutting blade occurs, so that it is preferably in the above-mentioned range. Since the contact surface pressure is high in the circumferential direction of die cutter, there is a possibility of chipping of the projecting pressure cutting blade. Therefore, the circumferential blade width dc has to be set large.

The axial edge apex angle θa is set to 120° or a lower level so that the edge width does not greatly increase due to the abrasion of the edge. However, when this apex angle is not more than 60°, the chipping of the edge becomes liable to occur. Since the contact surface pressure in the circumferential direction of the die cutter is high, there is a possibility of occurrence of the chipping of the edge, so that the circumferential edge apex angle θc has to be set large.

An about 1 mm thick polyethylene film as a work for obtaining sanitary napkins was cut by using the die cut roll according to the present invention. The edge widths d in the axial direction (da) and in the circumferential direction perpendicular thereto (dc) were set to 10 μm and 20 μm respectively, and the axial and circumferential apex angles, θa and θc, respectively, were set to 100° and 110° respectively. A similar film was cut to a predetermined shape by using a conventional edge having the same axial and circumferential edge widths da and dc of 20 μm and apex angles θa and θc of 90°. These two film cutting operations were compared with each other by using a die cut roll comprising a combination of a die cutter and an anvil roll, both of which were formed out of a WC—Co sintered hard alloy.

According to this embodiment, the anvil roll pressing cycle in the present invention was lengthened as compared with that in the conventional die cut roll, and a long lifetime, which was about 1.5 times as large as that of the conventional die cut roll, could be attained.

This effect was, for one thing, ascribed to the inclined finishing surfaces 7 of a surface roughness Ra of less than 0.3 μm formed between the top smooth portion 4 and inclined grinding surfaces 5 of the edge of the projecting pressure cutting blade 1 of the die cutter so that the inclined finishing surfaces 7 were ground to form grinding flaws extending at 50°–90°, and preferably 80°–90° with respect to the ridgelines of the top smooth surface portion 4. This effect was also ascribed to the compounded specific conditions for the width and apex angle of the edge. It was also ascertained that, even when the respective conditions were utilized independently, different effects were obtained, though the levels thereof were various.

When the direction in which the inclined finishing surfaces are ground is not perpendicular to the ridgelines of the top smooth portion 4, the same effect can also be obtained by setting the surface roughness Ra to less than 0.1 μm. The reason resides in that setting the surface roughness Ra of the inclined finishing surface to less than 0.1 μm serves to eliminate the microscopic notches which cause the minute chippings of the projecting pressure cutting blade to occur.

Embodiment 2

In this embodiment, die cutters 2 and anvil rolls 3 all of which were formed out of a WC—Co sintered hard alloy were used, in which compounding ratios of WC were varied to set the hardness of at least the top side portions of projecting pressure cutting blades 1 on the die cutter rolls 2 and that of at least the roll surfaces of the anvil rolls 3 to different levels, whereby die cutters and anvil rolls which had different hardness differences were provided for different driving systems employed.

Figure 3:
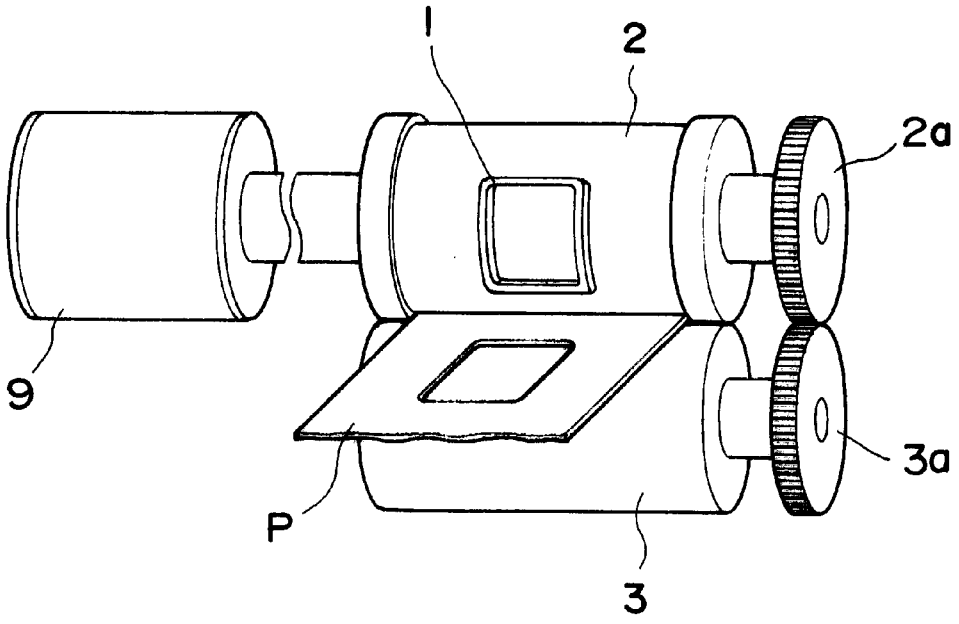
FIG. 3 shows an example of a two-shaft driving type die cut roll to which the present invention is applied.

Referring to FIG. 3 showing an example of die cut roll of a two-shaft driving system, a driving shaft of a motor 9 directly drives a die cutter 2, and a die cutter gear 2*a* drives an anvil roll gear 3*a*, a driving shaft connected to the anvil roll gear 3*a* driving an anvil roll 3 synchronously, whereby a sheet type work P passing between the die cutter 2 and anvil roll 3 is cut to a shape in accordance with that of a projecting pressure cutting blade 1.

The die cutter 2 and anvil roll 3 were formed so that the relational expression $0<H_2-H_1<5$ wherein $82\leqq(H_1, H_2)\leqq 96$ ($H_RA$) is established, wherein $H_1$ represents the hardness ($H_RA$) of at least the top side portion of the projecting pressure cutting blade 1, and $H_2$ the hardness ($H_RA$) of at least the surface of the anvil roll.

Figure 5:
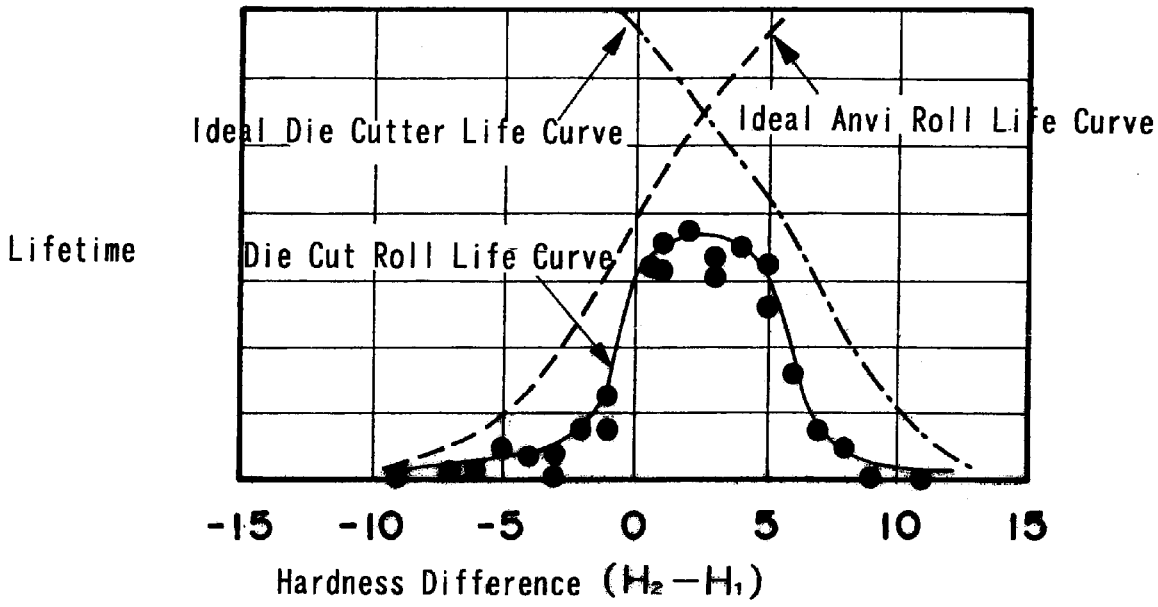
FIG. 5 shows the relation between a hardness difference and lifetime of the two-shaft driving type die cut roll.

The relation between a difference ($H_2-H_1$) between the hardness ($H_RA$)$H_1$ of the top side portion of the edge of the die cutter 2 in the two-shaft driving system of FIG. 3 and that ($H_RA$)$H_2$ of the anvil roll 3, and the lifetime of the test machines manufactured with the hardness differences ($H_RA$) set to various levels is shown in the form of a lifetime curve of die cut rolls in FIG. 5. The ideal die cutter lifetime curve and ideal anvil roll lifetime curve are lifetime curves obtained when the die cut rolls are operated without encountering the abrasion of the anvil rolls and die cutters.

The reason for attaining the relational expression $0<H_2-H_1$ resides in the following. When the projecting pressure cutting blade 1 of the die cutter 2 is harder than the anvil roll 3, the pressing force is concentrated on the surface of the anvil roll 3 to wear the same. Especially, when the die cutter and anvil roll are rotated synchronously, abrasion occurs in a concentrated manner on the portions of the surface of the anvil roll 3 which the cutting blade 1 of the die cutter 2 contacts, so that the lifetime of the die cut roll decreases to such a level that gives rise to practical problems. Furthermore, the tenacity of the edge of the die cutter 2 relatively decreases as compared with that of the anvil roll 3, and this causes the chipping of the edge of the die cutter 2 to occur.

The reason why the difference $H_2-H_1$ was set to $H_2-H_1<5$ resides in the following. When $H_2-H_1$ is set larger than 5, the hardness of the die cutter 2 becomes too low as compared with that of the anvil roll 3, and the abrasion of the edge of the die cutter 2 becomes liable to occur with the lifetime thereof decreasing to such a level that gives rise to practical problems.

Figure 4:
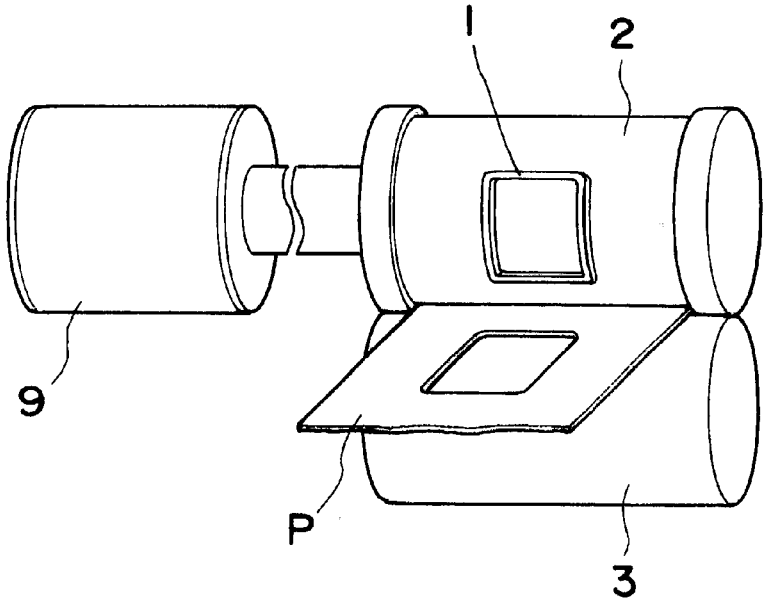
FIG. 4 shows an example of a single-shaft driving type die cut roll to which the present invention is applied.

Referring to FIG. 4 showing an example of a die cut roll of a single-shaft driving system to which the present invention is applied, a die cutter and an anvil roll were formed so that the relational expression $-5<H_2-H_1<1$ wherein $82\leqq(H_1, H_2)\leqq 96$($H_RA$) is established, wherein $H_1$ represents the hardness ($H_RA$) of at least a top side portion of a projecting pressure cutting blade 1 of the die cutter, and $H_2$ the hardness ($H_RA$) of at least the surface of the anvil roll.

Figure 6:
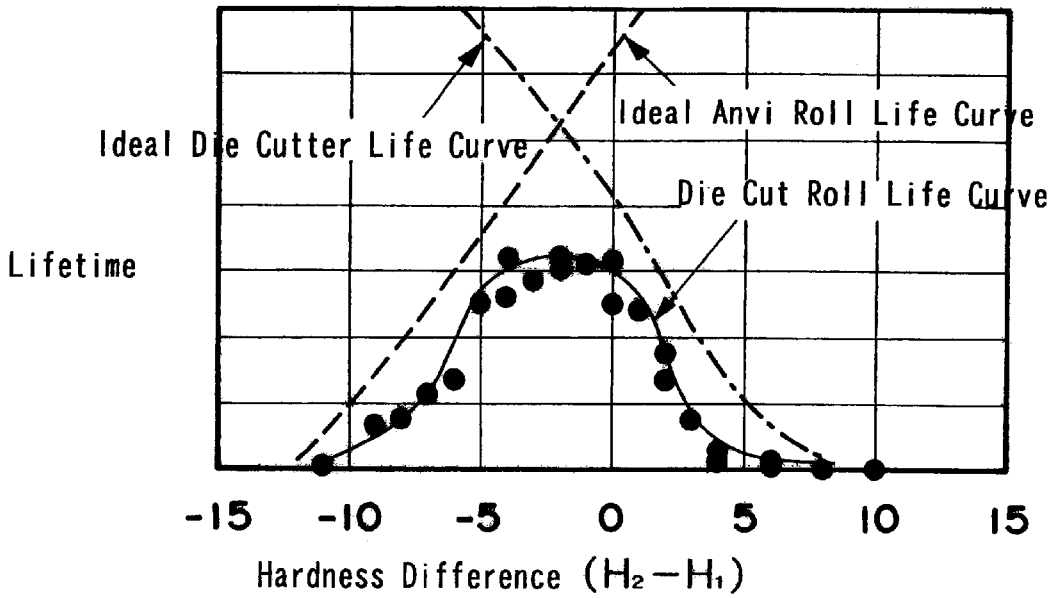
FIG. 6 shows the relation between a hardness difference and lifetime of the single-shaft driving type die cut roll.

The relation between a difference ($H_2-H_1$) between the hardness ($H_RA$)$H_1$ of the top side portion of the edge of the die cutter 2 in the single-shaft driving system of FIG. 4 and that ($H_RA$)$H_2$ of the anvil roll 3, and the lifetime of the test machines manufactured with the hardness differences ($H_RA$) set to various levels is shown in FIG. 6.

As compared with the case of the die cut roll of a two-shaft driving system, a load is imparted to the projecting pressure cutting blade 1 while the die cutter frictionally drives the anvil roll 3 via the work P, so that the lifetime of the die cut rolls of a single-shaft driving system generally decreases. The lifetime of the anvil rolls 3 generally increases since the abrasion spreads over the whole surface of each thereof to cause an abrasion rate to decrease. When the hardness difference is set in the range of $-5<H_2-H_1$, the lifetime of the die cut roll reaches a maximum level.

The reason why the hardness difference was set to $-5<H_2-H_1$ resides in the following. When the hardness difference $H_2-H_1$ is set smaller than −5, the abrasion rate of the anvil roll 3 becomes markedly high as compared with that of the die cutter 2 to cause the lifetime thereof to decrease, and the tenacity of the projecting pressure cutting blade 1 of the die cutter 2 decreases as compared with that of the anvil roll 3 to cause the edge of the projecting pressure cutting blade 1 to be chipped.

The hardness difference was set to $H_2-H_1<1$ because, when $H_2-H_1$ is set larger than 1, the hardness of the die cutter 2 becomes excessively low as compared with that of the anvil roll 3, and the wear on the edge of the cutting blade of the die cutter 2 becomes liable to occur.

Embodiment 3

This embodiment was provided with supporting blades, which did not directly serve to cut products, in addition to the projecting pressure cutting blades provided on the above embodiments. The provision of the supporting blades enables the concentration of excessively large repeated stress on the edge of the projecting pressure cutting blades to be lessened.

Figure 7:
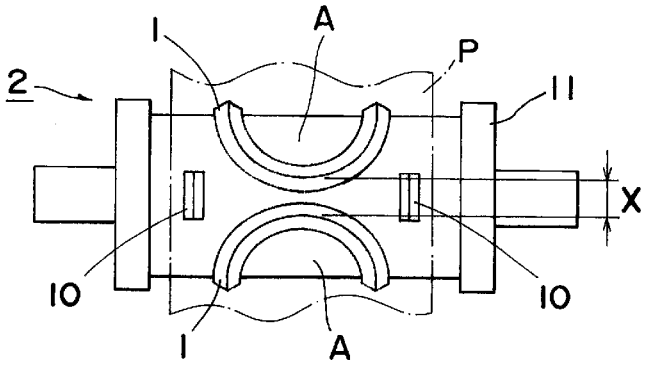
FIG. 7 shows an example of a die cutter in the present invention, provided with projecting pressure cutting blades not directly working to cut a product, so-called supporting blades in addition to proper projecting pressure cutting blades.

Referring to FIG. 7, a die cutter 2 having guide flanges 11 on circumferential portions of both ends thereof is provided with projecting pressure cutting blades 1 formed in accordance with the shape of paper products to define product cutting regions A on the inner sides thereof. 10 denotes projecting pressure cutting blades not directly working to cut products of the present invention, i.e. so-called supporting blades provided besides the product-obtaining projecting pressure cutting blades 1. The supporting blades 10 are provided so as to compensate for a circumferentially discontinuous portion shown by X of the rotary driving roll body so as to extend in the circumferential direction thereof. The supporting blades 10 are formed of the same material as the projecting pressure cutting blades 1 so that the shape and height of the edges become the same as those thereof since stable cutting characteristics can be obtained by setting the abrasion rate of the waste blades substantially equal to that of the projecting pressure cutting blades 1. When a distance between the supporting blades is within the range of levels lower than that of the width of work paper P with the length of the former within the range of levels higher than that of the circumferential size of the discontinuous portion X of the die cutter 2, the excessively large repeated stress can be lessened, and the abrasion rates of the projecting pressure cutting blades 1 and supporting blades 10 can be set substantially equal, so that this die cut roll is advantageous in cutting performance and economical efficiency.

The supporting blades 10 may be provided in more than two axial rows or formed to an arcuate shape.

Embodiment 4

Figure 8:
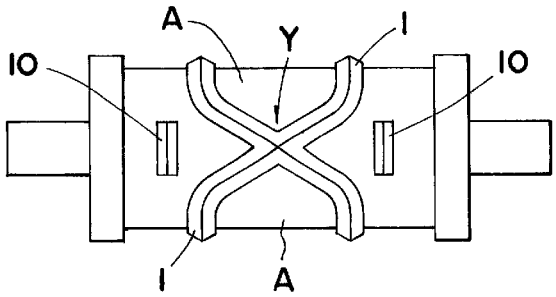
FIG. 8 shows another example of a die cutter in the present invention, having another type of supporting blades.

FIG. 8 shows a modified example of the supporting blades 10 of FIG. 7, which are provided on a die cutter 2, to which the present invention is applied, having two projecting pressure cutting blades 1 crossing each other to form continuous blades. Referring to FIG. 8, the supporting blades 10 are formed so as to compensate for an axially concentrated portion shown by Y of the projecting pressure cutting blades 1. The provision of these supporting blades 10 enables stress occurring due to a difference between the peripheral speed of the die cutter and that of the anvil roll and the feeding of a work to be lessened.

Embodiment 5

Figure 9:
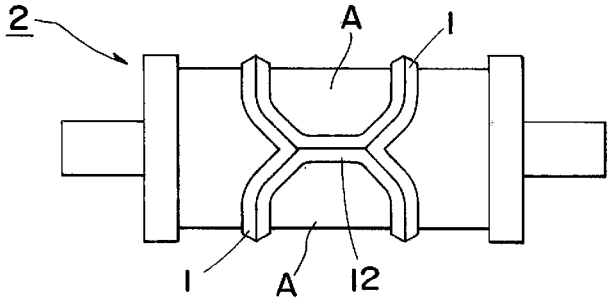
FIG. 9 shows still another example of a die cutter in the present invention, having parts substitutable for the supporting blades.

FIG. 9 shows an example provided with a continuous portion 12 formed on a die cutter 2 having two projecting pressure cutting blades 1 crossing each other, instead of providing such an independent supporting blades 10 as shown in FIG. 8, so as not to form a stress concentrated portion. This continuous portion 12 comprises not a one-point cross of the projecting pressure cutting blades 1 having product cutting regions A but a linear continuous cross thereof elongated in the axial direction of the cutter roll. This continuous portion 12 extending in the axial direction of the die cutter 2 may also be formed so as to include circumferentially extending sections, or so as to extend in the circumferential direction, for the purpose of preventing the formation of a stress concentrated portion. This enables the concentrtation of an excessively large repeated stress on the two projecting pressure cutting blades 1 to be lessened.

Embodiment 6

Figure 10:
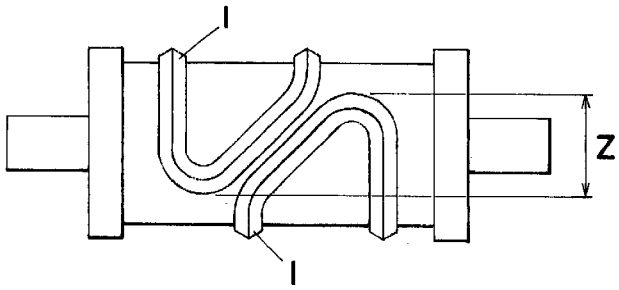
FIG. 10 shows a further example of a die cutter in the present invention, having another type of parts substitutable for the supporting blades.

FIG. 10 shows another example which is not provided with supporting blades either just as Embodiment 5, and which is provided with projecting pressure cutting blades 1 so as to extend in the direction of the whole circumference of the die cutter for the purpose of preventing the formation of a stress concentrated portion. In the example of FIG. 10, plural projecting pressure cutting blades 1 formed in accordance with the shape of products to be cut are arranged side by side in the circumferential direction of a die cutter. These projecting pressure cutting blades 1 are disposed side by side circumferentially in a range Z including at least their respective circumferential end portions, so that stress concentration on the circumferential end portions of the cutting blades can be avoided.

In Embodiments 5 and 6, supporting blades 10, which were provided in Embodiments 3 and 4 besides the projecting pressure cutting blades 1, can, of course, be used additionally.

INDUSTRIAL APPLICABILITY

A die cut roll of a long lifetime can be provided which is capable of preventing the occurrence of minute chippings of the edges of the axially extending projecting pressure cutting blades, and maintaining a cutting performance even when the width of the edges increases due to the abrasion of the top smooth portions.

A die cut roll of a long lifetime which has a long pressing cycle, especially, in an initial operating period can be provided.

A die cut roll having a lasting cutting quality without encountering abnormal abrasion of the edges of the cutting blades, can be provided.

The prevention of the chipping of edges of the cutting blades and the prolongation of the lifetime of a die cut roll, which are necessary to maintain a required shape of edges on contact surfaces of the cutting blades, can be attained by reducing the width of the edges of the projecting pressure cutting blades extending in the axial direction of a cutter.

What is claimed is:

1. A die cut roll comprising a rotary driving roll having projecting pressure cutting blades on a surface thereof formed in accordance with the shape of a product to be cut to thereby form a die cutter, and an anvil roll adapted to receive an edge of each of said projecting pressure cutting blades of said die cutter, said rotary driving roll comprising inclined finishing surfaces formed adjacent to a top smooth portion of an edge of each of said projecting pressure cutting blades by a grinding process so that said inclined finishing surfaces have grinding flaws which make an angle $\phi$ of 50°–90° to ridgelines defining said top smooth portion.

2. A die cut roll according to claim 1, wherein a surface roughness Ra of said inclined finishing surfaces is less than 0.3 $\mu$m.

3. A die cut roll according to claim 1, wherein said projecting pressure cutting blades extend in axial and circumferential directions of said rotary driving roll, at least one of an edge width and an apex angle of said projecting pressure cutting blades extending in the axial direction of said rotary driving roll being smaller than a corresponding one of an edge width and an apex angle of said projecting pressure cutting blades extending in the circumferential direction of said rotary driving roll.

4. A die cut roll according to claim 3, wherein the edge width, designated da, and apex angle, designated $\theta a$, of said projecting pressure cutting blades extending in the axial direction of said rotary driving roll and the edge width, designated dc, and apex angle, designated $\theta c$, of said projecting pressure cutting blades extending in the circumferential direction of said rotary driving roll satisfy the conditions $5 \leqq da \leqq 10$ $\mu$m, $60 \leqq \theta a \leqq 120°$, $10 \leqq dc \leqq 30$ $\mu$m, $80 \leqq \theta c \leqq 140°$, and $\theta a \leqq \theta c$.

5. A die cut roll according to claim 1, wherein a hardness difference is given to at least the top side portions of said cutting blades of said die cutter and at least a roll surface of said anvil roll, said hardness difference being set to different levels between a die cut roll of a two-shaft driving type die cutter and a die cut roll of a single-shaft driving type die cutter.

6. A die cut roll according to claim 5, wherein, when said die cutter and said anvil roll are driven by two shafts, the relational expression $0<H_2-H_1<5$ wherein $82\leqq(H_1, H_2)\leqq 96$ ($H_RA$) is established, wherein $H_1$ represents the hardness ($H_RA$) of at least a top side portion of said cutting blade of said die cutter, and $H_2$ the hardness ($H_RA$) of at least the roll surface of said anvil roll.

7. A die cut roll according to claim 5, wherein, when said die cutter and said anvil roll are driven by a single shaft, the relational expression $-5<H_2-H_1<1$ wherein $82\leqq(H_1, H_2)\leqq 96$ ($H_RA$) is established, wherein $H_1$ represents the hardness ($H_RA$) of at least a topside portion of said cutting blade of said die cutter, and $H_2$ the hardness ($H_RA$) of at least the roll surface of said anvil roll.

8. A die cut roll according to claim 1, further comprising supporting blades arranged on a region of said rotary driving roll which covers circumferentially discontinuous portions of said product cutting projecting pressure cutting blades, said supporting blades extending in a circumferential direction of said rotary driving roll.

9. A die cut roll according to claim 8, wherein said supporting blades cover at least concentrated portions with respect to the axial direction of said rotary driving roll of said product cutting projecting pressure cutting blades.

10. A die cut roll according to claim 8, wherein said supporting blades extend in the direction of the entire circumference of said rotary driving roll.

11. A die cut roll according to any one of claims 8–10, wherein the hardness ($H_RA$)$H_1$ of a top side portion of each of said supporting blades is in the range of $82\leqq H_1\leqq 96$.

12. A die cut roll according to any one of claims 8–10, wherein the hardness ($H_RA$)$H_1$ of the top side portion of each of said product cutting projecting pressure cutting blades formed in accordance with the shape of a product to be cut is in the range of $82\leqq H_1\leqq 96$.

13. A die cut roll according to claim 1, wherein: product cutting regions of said projecting pressure cutting blades are disposed side by side in the circumferential direction of said rotary driving roll.

14. A die cut roll according to claim 1, wherein said inclined finishing surfaces have grinding flaws which make an angle $\phi$ of 80°–90° to the ridgelines defining said top smooth portion.

15. A die cut roll according to claim 1, wherein said projecting pressure cutting blades extend in axial and circumferential directions of said rotary driving roll, an edge width of said projecting pressure cutting blades extending in the axial direction of said rotary driving roll being smaller than an edge width of said projecting pressure cutting blades extending in the circumferential direction of said rotary driving roll and an apex angle of said projecting pressure cutting blades extending in the axial direction of said rotary driving roll being smaller than an apex angle of said projecting pressure cutting blades extending in the circumferential direction of said rotary driving roll.

16. A die cut roll comprising a rotary driving roll having projecting pressure cutting blades on a surface thereof formed in accordance with the shape of a product to be cut to thereby form a die cutter, and an anvil roll adapted to receive an edge of each of said projecting pressure cutting blades of said die cutter, said rotary driving roll comprising inclined finishing surfaces formed adjacent to a top smooth portion of an edge of each of said projecting pressure cutting blades by a grinding process so that said inclined finishing surfaces make an angle $\phi$ of 50°–90° to ridgelines defining said top smooth portion, said projecting pressure cutting blades extending in axial and circumferential directions of said rotary driving roll, at least one of an edge width and an apex angle of said projecting pressure cutting blades extending in the axial direction of said rotary driving roll being smaller than a corresponding one of an edge width and an apex angle of said projecting pressure cutting blades extending in the circumferential direction of said rotary driving roll.

17. A die cut roll according to claim 16, wherein the surface roughness Ra of said inclined finishing surfaces is less than 0.3 $\mu$m.

18. A die cut roll according to claim 10 or 17, wherein the edge width, designated da, and apex angle, designated $\theta$a, of said projecting pressure cutting blades extending in the axial direction of said rotary driving roll and the edge width, designated dc, and apex angle, designated $\theta$c, of said projecting pressure cutting blades extending in the circumferential direction of said rotary driving roll satisfy the conditions $5\leqq da\leqq 10$ $\mu$m, $60\leqq\theta a\leqq 120°$, $10\leqq dc\leqq 30$ $\mu$m, $80\leqq\theta c\leqq 140°$, and $\theta a\leqq\theta c$.

19. A die cut roll according to claim 10, wherein said inclined finishing surfaces have grinding flaws which make an angle $\phi$ of 80°–90° to the ridgelines defining said top smooth portion.

20. A die cut roll according to claim 16, wherein an edge width of said projecting pressure cutting blades extending in the axial direction of said rotary driving roll is smaller than an edge width of said projecting pressure cutting blades extending in the circumferential direction of said rotary driving roll and an apex angle of said projecting pressure cutting blades extending in the axial direction of said rotary driving roll is smaller than an apex angle of said projecting pressure cutting blades extending in the circumferential direction of said rotary driving roll.

21. A die cut roll comprising a rotary driving roll having projecting pressure cutting blades formed in accordance with the shape of a product to be cut to thereby form a die cutter, and an anvil roll adapted to receive an edge of each of said projecting pressure cutting blades of said die cutter, said rotary driving roll comprising inclined finishing surfaces having a surface roughness Ra of less than 0.1 $\mu$m formed on ridgeline—including surface portions adjacent to a top smooth portion of an edge of said projecting pressure cutting blade, said projecting pressure cutting blades extending in axial and circumferential directions of said rotary driving roll, at least one of an edge width and an apex angle of said projecting pressure cutting blades extending in the axial direction of said rotary driving roll being smaller than a corresponding one of an edge width and an apex angle of said projecting pressure cutting blades extending in the circumferential direction of said rotary driving roll.

22. A die cut roll according to claim 21, wherein the edge width, designated da, and apex angle, designated $\theta$a, of said projecting pressure cutting blades extending in the axial direction of said rotary driving roll and the edge width, designated dc, and apex angle, designated $\theta$c, of said projecting pressure cutting blades extending in the circumferential direction of said rotary driving roll satisfy the conditions $5 \leqq da \leqq 10$ μm, $60 \leqq \theta a \leqq 120°$, $10 \leqq dc \leqq 30$ μm, $80 \leqq \theta c \leqq 140°$, and $\theta a \leqq \theta c$.

23. A die cut roll according to claim 21, wherein an edge width of said projecting pressure cutting blades extending in the axial direction of said rotary driving roll is smaller than an edge width of said projecting pressure cutting blades extending in the circumferential direction of said rotary driving roll and an apex angle of said projecting pressure cutting blades extending in the axial direction of said rotary driving roll is smaller than an apex angle of said projecting pressure cutting blades extending in the circumferential direction of said rotary driving roll.

24. A die cut roll comprising a rotary driving roll having projecting pressure cutting blades on a surface thereof formed in accordance with the shape of a product to be cut to thereby form a die cutter, and an anvil roll adapted to receive an edge of each of said projecting pressure cutting blades of said die cutter, said rotary driving roll comprising inclined finishing surfaces formed adjacent to a top smooth portion of an edge of each of said projecting pressure cutting blades so that said inclined finishing surfaces have flaws which make an angle $\phi$ of 50°–90° to ridgelines defining said top smooth portion.

25. A die cut roll comprising a rotary driving roll having projecting pressure cutting blades on a surface thereof formed in accordance with the shape of a product to be cut to thereby form a die cutter, and an anvil roll adapted to receive an edge of each of said projecting pressure cutting blades of said die cutter, said rotary driving roll comprising inclined finishing surfaces formed adjacent to a top smooth portion of an edge of each of said projecting pressure cutting blades by a grinding process so that said inclined finishing surfaces make an angle $\phi$ of 50°–90° to ridgelines defining said top smooth portion, said projecting pressure cutting blades extending in axial and circumferential directions of said rotary driving roll, at least one of an edge width and an apex angle of said projecting pressure cutting blades extending in the axial direction of said rotary driving roll being smaller than a corresponding one of an edge width and an apex angle of said projecting pressure cutting blades extending in the circumferential direction of said rotary driving roll.

* * * * *